United States Patent [19]

Gazzara

[11] 4,257,386

[45] Mar. 24, 1981

[54] BOW STRING DRAWING AND RELEASING DEVICE

[76] Inventor: Matthew R. Gazzara, 345 White Horse Pike, Hammonton, N.J. 08037

[21] Appl. No.: 10,035

[22] Filed: Feb. 7, 1979

[51] Int. Cl.[3] ..... F41B 5/00

[52] U.S. Cl. ..... 124/35 A

[58] Field of Search ..... 124/35 A, 24 R, 23 R, 124/41 A

[56] References Cited

U.S. PATENT DOCUMENTS

| | | | |
|---|---|---|---|
| 1,542,159 | 6/1925 | Maxwell | 124/35 A |
| 2,488,597 | 11/1949 | Konold . | |
| 2,819,707 | 1/1958 | Kayfes et al. | 124/35 A |
| 3,604,407 | 9/1971 | Wilson . | |
| 3,800,774 | 4/1974 | Troncoso . | |
| 3,948,243 | 4/1976 | Gazzara . | |

*Primary Examiner*—William R. Browne

*Attorney, Agent, or Firm*—Weiser, Stapler & Spivak

[57] ABSTRACT

A bow string drawing and releasing device including a rigid frame within which a pair of jaws are pivotally arranged. An operating rod is rearwardly positioned and is adapted to be rearwardly pulled to pivot the jaws from a normally closed, bow string retaining position to an open, bow string releasing position. A handle grip portion extends rearwardly from the frame and the operating rod extends through the handle grip portion. In one embodiment, the handle grip portion is adapted to rotate relative to the frame. In another embodiment, the handle grip portion is adapted to pivot relative to the frame for triggering purposes.

24 Claims, 15 Drawing Figures

FIG. 15
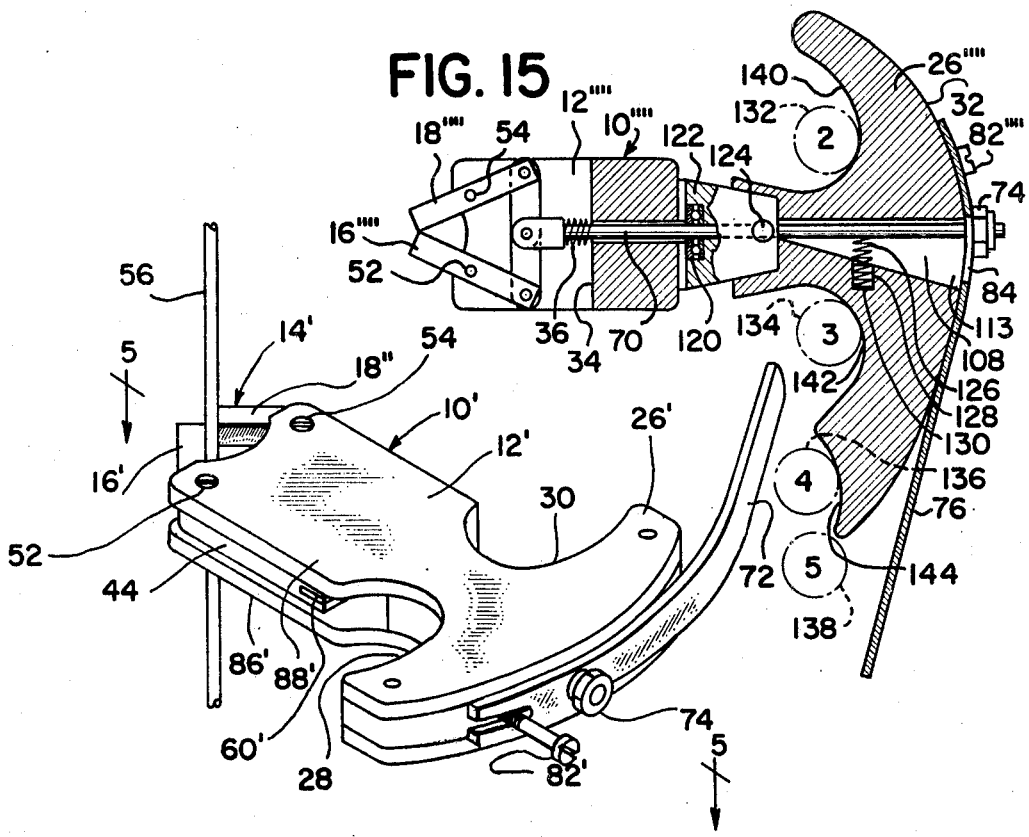
FIG. 4
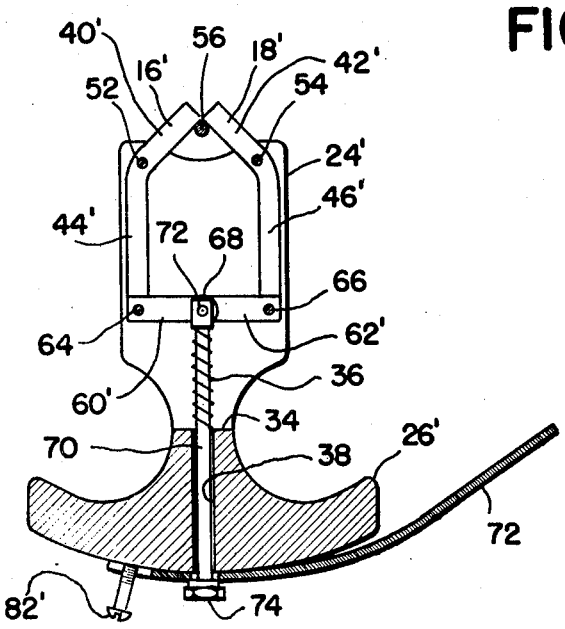
FIG. 5
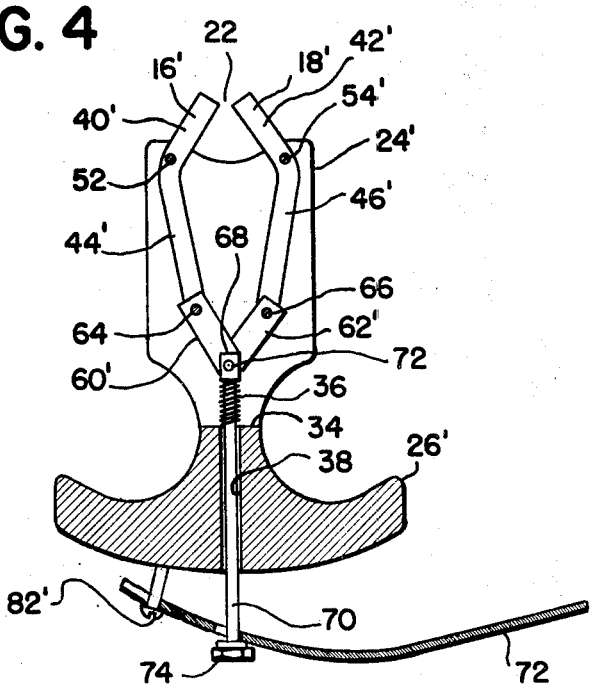
FIG. 6

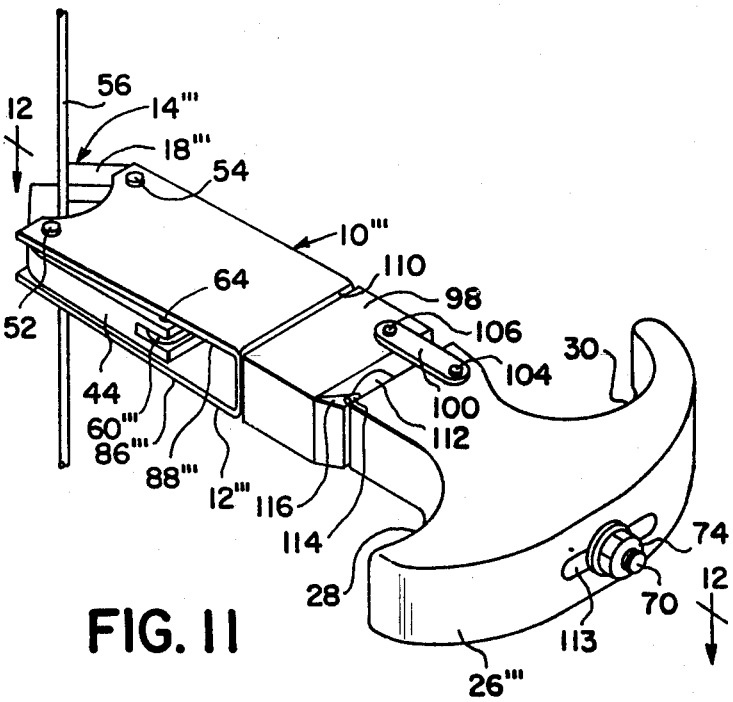
FIG. 11
FIG. 14
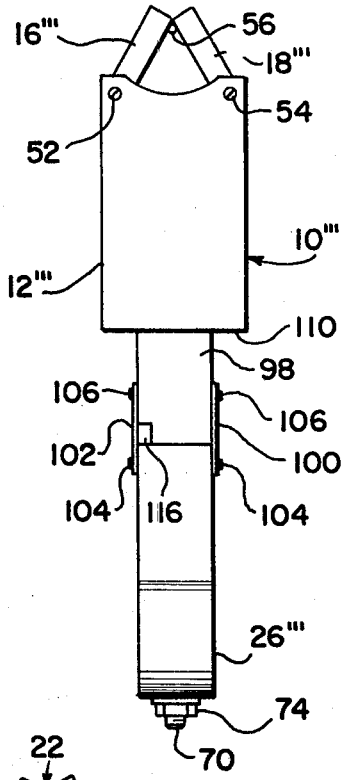
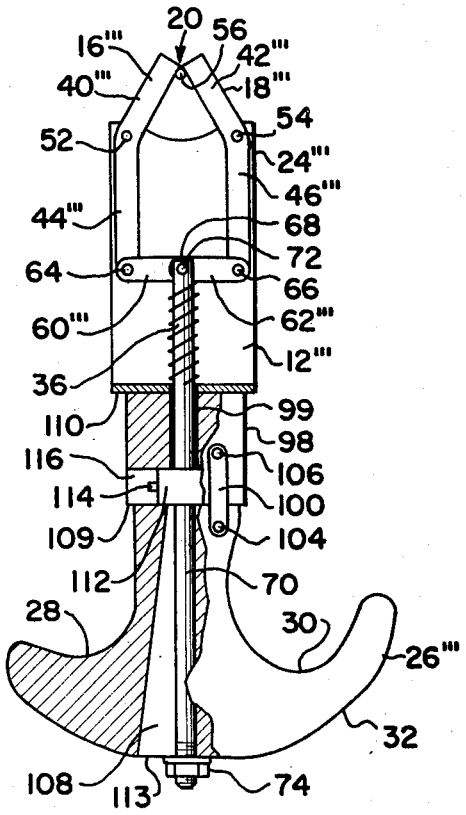
FIG. 12
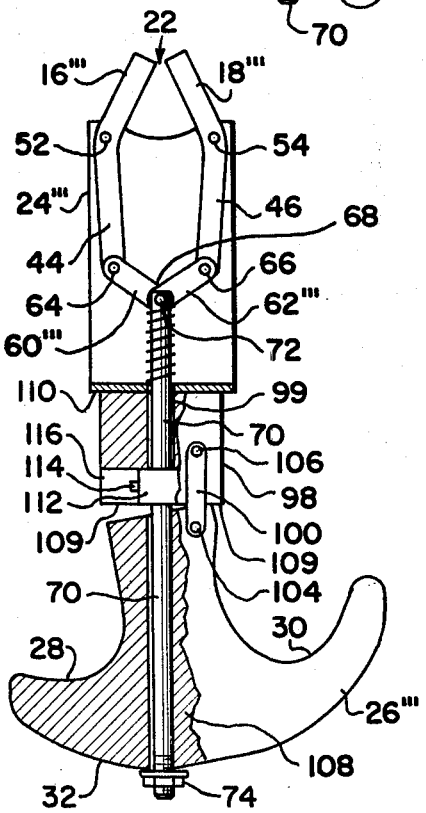
FIG. 13

BOW STRING DRAWING AND RELEASING DEVICE

BACKGROUND OF THE INVENTION

The present invention relates generally to the field of archery equipment and more particularly is directed to a pivoting type of bow string drawing and releasing device.

As set forth in my previous patent, U.S. Pat. No. 3,948,243, persons who enjoy the sport of archery have found that the speed, accuracy and distance to which arrows can be propelled is a direct function of the spring constant of the bow and the strength of the archer necessary to pull the bow string through a distance against the natural spring bias of the bow itself. As bows become sturdier, they offer a greater resistance to bending and so require greater strength on the part of the archer to produce the desired results.

It is the usual practice to employ two fingers to pull the bow string rearwardly. Of course, definite limitations are presented because all of the strength of the archer cannot be readily applied to the bow string by employing only the two fingers for bow string drawing and releasing purposes. By employing a mechanical bow string drawing device, the pressure limitations created by the interaction of the bow string itself upon the fingers of the archer when drawing bow string can be overcome to a considerable degree. In addition to U.S. Pat. No. 3,948,243, previously mentioned, U.S. Pat. Nos. 1,542,159, 2,488,597, 2,977,952, 3,343,839, 3,604,407 and 3,800,774 all show exemplary types of prior art bow trigger mechanisms.

The prior art bow trigger mechanisms with which I am familiar are generally satisfactory in performance, but some are somewhat limited in their application due to the complexity of the systems and in the difficulty in operation presented by the various prior art mechanisms. The present invention represents an improved trigger mechanism of the pivoting type which some archers will find easier or more comfortable to operate than the devices heretofore developed.

SUMMARY OF THE INVENTION

The present invention relates generally to the field of bow string drawing and releasing devices and more particularly, is directed to a device incorporating spring biased, pivotal jaws. The bow string drawing and releasing device of the present invention comprises generally a rigid frame within which are pivotally arranged a pair of bow string contacting and releasing jaws. The jaws include operating links which are rearwardly connected and which in turn affix to an operating or triggering rod.

The frame terminates rearwardly in a comfortable handle of suitable configuration to be readily grasped and strongly retained by the fingers and hands of a user. The operating rod is reciprocal through the handle and terminates rearwardly in trigger means which may be of the pivotal type. The trigger means extends transversely outwardly from the handle and terminates in a position to be easily pulled by one of the fingers of the archer for bow string releasing purposes.

In a preferred embodiment, a coil spring encircles the operating rod and biases between the frame and the operating linkage to normally urge the jaws to the closed position about the bow string. The archer must pull against and overcome the bias of the spring in order to trigger the bow.

The triggering lever is bent to the outer configuration of the handle in a manner to assure that the lever is retained in close association with the handle during the bow string drawing operations. In this position, the operating rod and connecting linkage are reciprocated forwardly to the closed and locked position whereby the jaws cannot be disassociated from the bow string without conscious effort on the part of the archer. When it is desired to release the bow string, the archer may grasp and pull the operating lever rearwardly, thereby urging the operating rod, and the connecting linkage rearwardly in a manner to pivot the jaws about their respective frame connected pivots to an open condition whereby a space is defined between the jaws, through which space the bow string can be released to thus release the bow string and send the arrow on its flight. Optionally, the device can be triggered directly through the frame by direct application of rearwardly directed forces upon the connecting linkage.

In an embodiment of the invention, the handle grip portion is adapted to rotate through three hundred and sixty degrees relative to the frame to compensate for any torsion or twisting as the bow string is drawn to thereby isolate the bow string from any such influence. This rotative feature allows the archer to rotate the handle grip portion to any position comfortable to him as the bow string is drawn. A thrust bearing is provided to facilitate the handle grip rotation.

In another embodiment of the invention, the channel through the handle grip which is provided for the passage of the operating rod is generally V-shaped in configuration and pivot means between the handle grip portion and the frame is incorporated. By utilizing a pivotal means interconnecting the frame and handle grip portions, triggering can be achieved by pivoting the handle grip portion. In a preferred embodiment, the pivot means is centered upon the operating rod in a manner to allow the archer to pull or draw with equal pressure on both sides of the handle and to release the bow string by merely shifting the pull on the handle slightly to one side.

It is therefore an object of the present invention to provide an improved bow string drawing and releasing device of the type set forth.

It is a further object of the present invention to provide a novel bow string drawing and releasing device including means to permit more efficient utilization of the strength of the archer in pulling the bow string rearwardly.

It is another object of the present invention to provide a novel bow string drawing and releasing device including a fixed frame and jaws pivotal within the frame between a bow string drawing position and a bow string releasing position.

It is another object of the present invention to provide a novel bow string drawing and releasing device comprising a rigid frame, the said frame terminating rearwardly in a handle, a pair of bow string drawing jaws pivotally mounted within the frame and operating rod means reciprocal relative to the frame to function the jaws pivotally between a bow string drawing position and a bow string releasing position.

It is another object of the present invention to provide a novel bow string drawing and releasing device that is inexpensive in manufacture, simple in application and trouble free when in use.

Other objects and a fuller understanding of the invention will be had by referring to the following description and claims of a preferred embodiment thereof taken in conjunction with the accompanying drawings wherein like reference characters refer to similar parts throughout the several views and in which:

BRIEF DESCRIPTION OF THE DRAWINGS

FIG. 4 is a perspective view of second embodiment of the invention.

FIG. 5 is a cross sectional view taken along line 5—5 of FIG. 4, showing the jaws in the bow string drawing position.

FIG. 6 is a view similar to FIG. 5 showing the jaws in the bow string releasing position.

FIG. 11 is a perspective view of a fourth embodiment of the invention.

FIG. 12 is a cross sectional view taken along line 12—12 of FIG. 11, showing the jaws in the bow string drawing position, partly broken away to expose interior construction details.

FIG. 13 is a cross sectional view similar to FIG. 12, showing the jaws in the bow string releasing position.

FIG. 14 is a view similar to FIG. 8 showing the handle and the body in respective angular arrangement.

FIG. 15 is a partial, top plan view of a fifth embodiment of the invention, partly broken away to expose interior construction details.

DESCRIPTION OF THE PREFERRED EMBODIMENTS OF THE INVENTION

Figure 1:
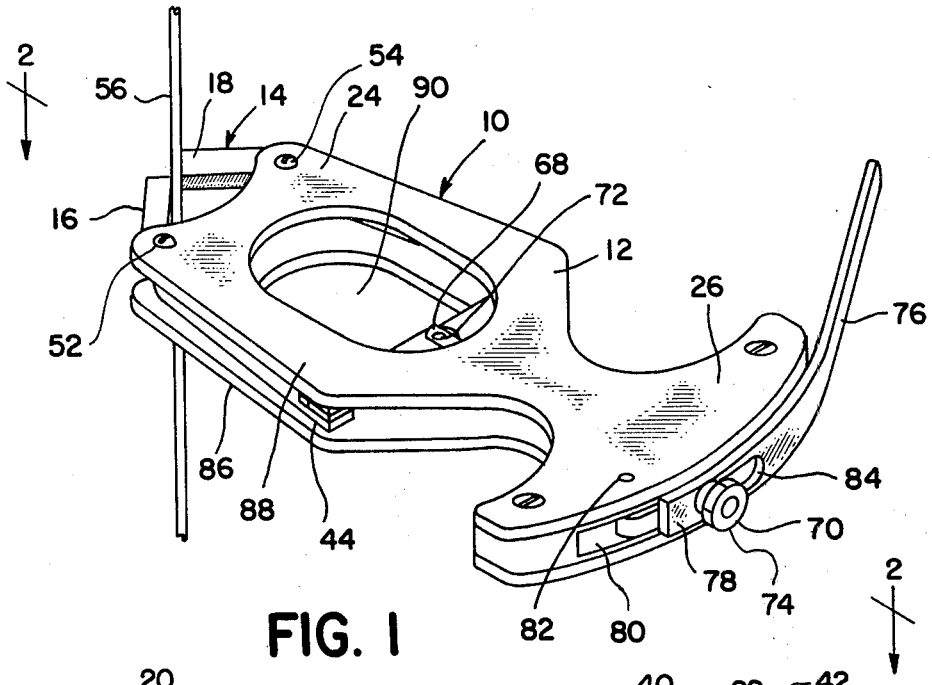
FIG. 1 is a perspective view of a first embodiment of the invention.

Although specific terms are used in the following description for the sake of clarity, these terms are intended only to refer to the particular structure of the invention selected for illustration in the drawings and are not intended to define or limit the scope of the invention.

Referring now to the drawings, there is shown in FIG. 1 a bow string drawing and releasing device generally designated 10 which comprises a rigid frame body 12 and bow string drawing means 14. The bow string drawing means 14 comprises a pair of openable jaws 16, 18, which jaws are pivotal within the frame 12 between a first, bow string drawing position 20 as illustrated in FIG. 2 to a second, bow string releasing position 22 as illustrated in FIG. 3.

Figure 2:
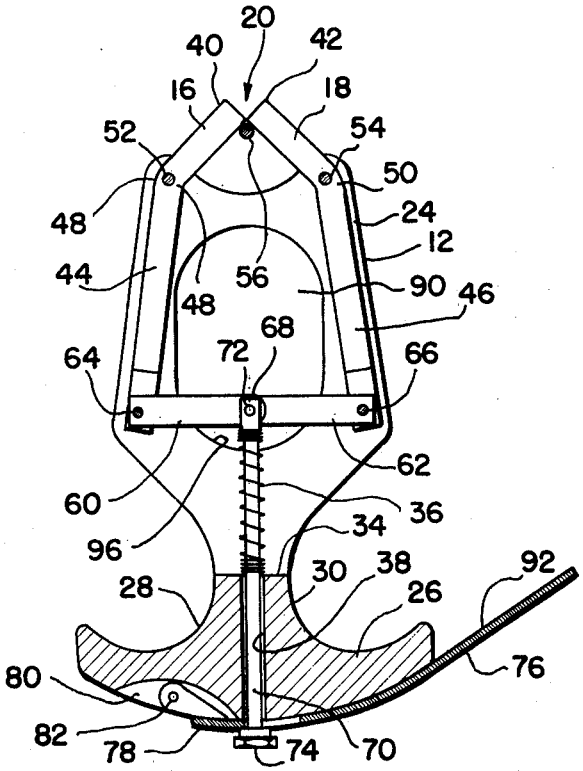
FIG. 2 is a cross sectional view taken along line 2—2 of FIG. 1, showing the jaws in the string drawing position.
Figure 3:
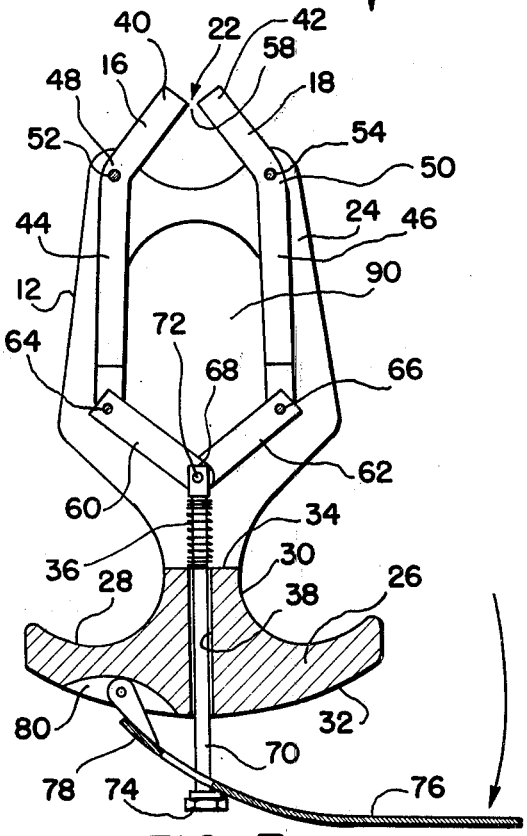
FIG. 3 is a view similar to FIG. 2 showing the jaws in the bow string releasing position.
Figure 7:
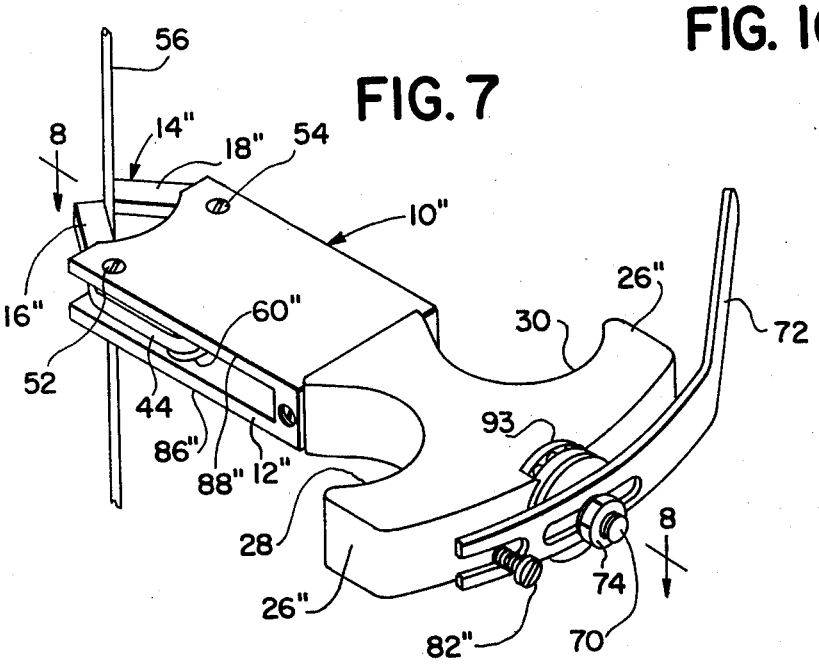
FIG. 7 is a perspective view of a third embodiment of the invention.
Figure 10:
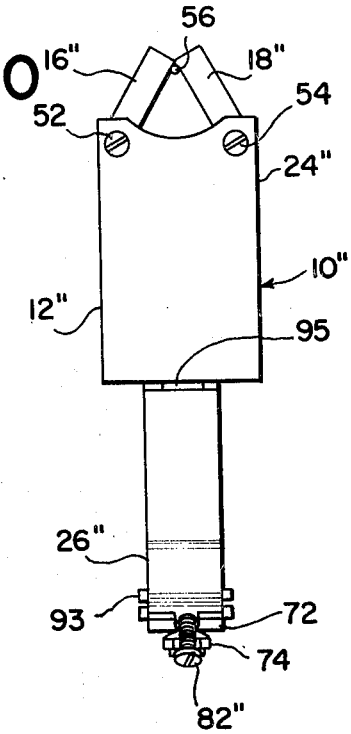
FIG. 10 is a view similar to FIG. 9 showing the handle and the body in respective angular arrangement.

As best seen in FIGS. 2 and 3, the rigid frame 12 is fabricated to a rigid construction and includes a forward, jaw holding portion 24 and an integral, solid, handle grip portion 26. The handle grip portion 26 preferably is generally solid in construction and is forwardly configured to provide convenient finger grip areas 28, 30 to permit the archer, (not shown) to grip the device 10 with two fingers during the bow string drawing and releasing procedures. The handle 26 terminates rearwardly in an arcuate rear wall 32 which is conveniently configured to fit within the palm of the user during all periods of use. The handle grip portion 26 terminates forwardly in a solid shoulder 34 of configuration suitable to support a fixed end of a coil spring 36, the operation of which will hereinafter be more fully explained.

The operating handle 26 is drilled or otherwise formed to provide an axially aligned passageway 38 through which a portion of the bow string drawing means 14 is reciprocal as illustrated in FIGS. 2 and 3. The jaw holding portion 24 is integral with the handle grip portion 26 and may be generally trapezoidal in configuration as illustrated in FIGS. 1—3 or generally rectangular in cross-sectional configuration as illustrated in FIGS. 4–6. It is noteworthy that the body 12 and the bow string drawing means 14 are particularly designed to by symmetrical about the longitudinal axis of the device 10 to assure uniform, longitudinally aligned operation of the device upon all conditions of use. Such longitudinal alignment discourages non-aligned movements which might have a tendency to adversely affect accuracy.

The bow string drawing means 14 comprises generally a pair of jaws 16, 18, which jaws are bent intermediate their respective bow string engaging ends 40, 42 and their operating ends 44, 46 to define bent fulcrums 48, 50. Respective pivot pins 52, 54 pivotally affix the jaws 16, 18 to the jaw holding portion 24 of the body 12 for operation relative to the body. Thus, when the respective operating ends 44, 46 are urged apart in the manner illustrated in FIG. 2, the jaws will pivot about the pins 52, 54 to urge the respective bow string engaging ends 40, 42 tightly together to thereby grip the bow string 56 for bow string drawing purposes. When the respective operating ends 44, 46 are drawn together in the manner illustrated in FIG. 3, the jaws 16, 18 are respectively pivoted about the pivot pins, 52, 54 to urge the bow string engaging ends 40, 42 apart sufficiently to define an opening 58 therebetween to release the bow string 56 upon triggering the device as hereinafter more fully set forth.

The bow string drawing means 14 comprises a pair of operating links 60, 62 which pivotally respectively connect to the operating ends 44, 46 of the jaws 16, 18 at the respective pivot pins 64, 66. In the embodiment illustrated, the links 60, 62 terminate inwardly in a longitudinally aligned pivotal connection 68, and pivotally interconnect with the forward end of the operating rod 70 at the pivot pin 72. The coil spring 36 encircles a portion of the operating rod 70 and biases between the handle grip portion shoulder 34 and the links 60, 62 at the pivotal connection 68 thereof. As best seen in FIGS. 2 and 3, the spring 36 continuously biases the pivotal connection 68 forwardly. The forward limit of travel of the pivotal connection 68 is defined by the operating rod head 74 which stops against the arcuate rear face 32.

As best seen in FIG. 2, when the operating rod 70 is biased to its forwardmost position, the operating links 60, 62 transversely align and push apart the operating ends 44, 46 the maximum distance to pivot the jaws 16, 18 the maximum degree about the pivot pins 52, 54. This action tightly urges the bow string engaging ends 40, 42 together to absolutely prevent escape of the bow string between the jaw ends 40, 42 when the bow string drawing means is biased to the said bow string drawing position 20.

As illustrated in FIG. 3, when the operating rod 70 is urged rearwardly in axially aligned relationship through the operating passageway 38, the pivotal connection 68 will simultaneously be urged rearwardly. The rearward movement of the pivotal connection 68 pulls the links 60, 62 out of their transversely aligned position. The pivotal connection 68 travels rearwardly against the bias of the spring 36 by compressing the spring as illustrated. The rearward movement of the pivotal connection 68 causes the respective jaw rearward ends 44, 46 to be pulled toward each other in the manner illustrated. The jaws then pivot about the respective pivot pins 52, 54 to function the device to the said bow string releasing position 22 by defining an opening 58 between the respective bow string engaging ends 40, 42 of the jaw members 16, 18. When the opening 58 is provided by pivoting the jaws 16, 18 as above set forth, the draw string 56 will be released rapidly through the defined opening 58 under the bow tension to thereby send the arrow (not shown) on its intended path.

An operating lever 76, which is operatively connected to the bow string drawing means 14, has its pivotal end 78 pivotally connected to the handle 26 at the recessed area 80 by utilizing a pivot pin 82. The lever 76 includes an elongated slot 84 through which the operating rod 70 extends. The operating rod head 74 connects outwardly of the lever to the rod 70 and acts to prevent disassociation of the parts upon all conditions of use. If desired, the rearward, curved face 32 of the handle grip portion 26 can be provided with an arcuate recess to receive the operating lever 76 therewithin to provide a flush mounting (not illustrated) when the parts are biased to the bow string drawing position 20.

In the preferred embodiment, the jaw holding portion 24 may be fabricated to provide a pair of parallel, spaced plates 86, 88 which are spaced apart sufficiently to permit the jaws 16, 18 to be readily pivotal therewithin without binding or other frictional engagement.

As illustrated in FIGS. 1–3, the jaw holding portion 24 may be provided with a central opening 90 within which the pivotal connection 68 is fully exposed. In the string drawing position 20, the pivotal connection 68 is positioned forwardly of the rear wall 96 of the opening 90 a distance sufficient to facilitate function of the means 14 to the string releasing position 22. The opening 90 is axially aligned and of size to permit an archer (not shown) to insert his finger (also not shown) through the opening 90 and to pull axially rearwardly on the links 60, 62 at the pivotal connection 68 for triggering purposes. It is noteworthy that the triggering forces thus applied will always be in axially alignment to thereby encourage proper use of the device without twisting, jerking or other unwanted movements. Additionally, the axial alignment of the operating passageway 38 also encourage smooth, axial functioning of the device to thereby render the bow string drawing and releasing device 10 more accurate when in use.

In the embodiment 10' illustrated in FIGS. 4–6, the operating mechanism is essentially the same as that illustrated in FIGS. 1–3, with the exception that no central opening 90 is provided as hereinbefore set forth and the jaw holding portion 24' is essentially rectangular in configuration. The jaw construction 16', 18', the pivots 52, 54, 64 and 66, the operating rod 70, spring 36, operating lever 76 and pivot 82' are essentially the same as illustrated in FIGS. 1–3 and so need not be further described. The basic difference between the embodiment of FIGS. 4–6, from that illustrated in FIGS. 1–3, is the absence of the central opening 90. In this embodiment, it is necessary to utilize the operating lever 76 for triggering purposes on all occasions.

In the embodiment of FIGS. 1–3, either a center pull at the connection 68 or function of the lever 76 can be utilized for triggering. It is preferable to provide a center pull within the opening 90 to assure that all forces act in essentially balanced, axially aligned relationship. To this end, the second and fourth fingers (not shown) are applied at the respective finger grip areas 28, 30 with the middle finger (not shown) positioned within the central opening 90. By pulling the links 60, 62 rearwardly at the pivotal connection 68 thereof, the string drawing means 14 can be pivoted to the releasing position 22, causing release of the bow string 56. The small finger or fifth finger overlies the free end 92 of the operating lever 76 and could optionally or additively provide forces to urge the operating rod 70 rearwardly. In this manner, the pivotal connection 68 can be rearwardly urged to the bow string releasing position 22 to define an opening 58 between the jaws 40, 42. By threadedly engaging the head 74 upon the operating rod 70, the trigger tension can be readily adjusted by the archer to suit his particular "feel" to render the device more comfortable in use.

Once the opening 58 is defined by pulling rearwardly on the pivotal connection 68, using either direct finger pressure on the connection 68 and/or pivotal forces applied at the operating lever 76, the bow string 56 can be introduced into the space 94 defined within the jaws 16, 18 and forwardly of the body 12. Upon releasing the rearward finger pressure on the pivotal connection 68 or on the free end 92 of the operating lever 76, the spring 36 functions to automatically and without conscious effort to push the pivotal connection 68 forwardly. The interaction of the operating rod head 74 against the arcuate rear surface 32 defines the forward limit of travel of the operating rod 70 and the pivotal connection 68. In this manner, the links 60, 62 will be biased to their aligned position in transverse relationship to the longitudinal axis of the device. When the links 60, 62 align, the distance between the pivots 64, 66 is maximized to pivot the jaws 16, 18 about the pivot pins 52, 54 the maximum degree.

The geometry of the system is designed to tightly close the spacing between the jaw engaging ends 40, 42 to prevent disengagement of the bow string 56 from within the defined space 94 when the links are biased to their aligned position as illustrated in FIG. 2. Then by pulling rearwardly at the finger grip areas 28, 30 utilizing the second finger and fourth fingers without pulling the connection 68 rearwardly, the bow string 56 can be pulled rearwardly the desired distance without slipping until it is desired to trigger the device.

When triggering, preferably the third finger which has been inserted into the opening 90 pulls the pivotal connection 68 rearwardly towards the rearward terminus 96 of the opening 90. This movement pivots the jaws 16, 18 to the releasing position 22. The device may also be triggered by pulling the operating rod 70 utilizing the small finger on the free end 92 of the operating lever 76. Thus, the jaws 16, 18 can be pivoted about the pivot pins 52, 54 to define the bow string releasing position 22 as illustrated in FIG. 3 to release the bow string 56 either by utilizing the middle finger to pull the pivotal connection 68 rearwardly or else by employing the small finger to pivot the lever 76 to also pull the connection 68 rearwardly. Once the bow string 56 has been released; the archer can release the pivotal connection 68 and the lever free end 92 (if utilized) to thereby allow the spring 36 to bias the operating rod 70 to the position 20 illustrated in FIGS. 2 with the links 60, 62 returned to transverse, aligned condition. The cycle once again can be initiated when it is again desired to engage the bow string 56 to shoot another arrow.

For those archers who may feel uncomfortable by utilizing the preferred method above set forth, it is entirely possible, for example, to utilize the second and third fingers to pull the device rearwardly by positioning the second and third fingers respectively within the finger grip areas 28, 30 with the free end 92 of the operating lever 90 positioned to be grasped by the operator's thumb. It is also possible to invert the release and then to utilize the fourth finger for triggering purposes.

It is noteworthy that all of the release modifications described herein can be employed by the archer for both right hand and left hand use without requiring any alterations whatsoever. By pulling rearwardly utilizing the second and third fingers, the bow string can be pulled rearwardly the desired distance and then triggering the device 10 can be accomplished by pulling rearwardly on the operating lever 76 utilizing the thumb until the operating rod 70 is rearwardly urged through a sufficiently distance to trigger the device 10. While longitudinally aligned triggering forces cannot be generated by use of the thumb upon the lever 76, it will be noted that the device functions in longitudinal alignment as the operating rod 70 travels within the longitudinally aligned operating passageway 38.

In the embodiment illustrated in FIGS. 4–6, the longitudinal operation on the part of the archer, (not shown) cannot be achieved inasmuch as there is no central opening. Several different methods of triggering could be employed, depending upon which is most comfortable for the archer. For example, the archer could utilize his second and third fingers within the finger grip areas 28, 30 to provide sufficient forces to pull the bow string 56 rearwardly. After pulling the bow string, triggering can be achieved by pulling rearwardly on the free end 92 of the operating lever 76 utilizing the user's thumb (not shown) or invert the release and trigger with the fourth finger pulled sufficiently rearwardly to release the bow string 56. Alternately, the free end 92 of the operating lever 76 could be positioned to be engaged by the user's little finger with the second and third fingers arranged to pull rearwardly on the finger grip areas 28, 30. After the bow string 56 is rearwardly pulled, the user's little finger could pull rearwardly on the lever end 92 to pivot the lever pivot end 78 about the pivot pin 82'. The pivotal lever action pulls rearwardly on the head 74 to pull the operating rod 70 rearwardly through the passageway 38 in axial alignment until sufficient pivotal movement of the jaws 16, 18 is produced to separate the jaw ends 40, 42 to release the bow string 56. The lever opening 84, through which the operating rod 70 extends is elongated as necessary to permit pivotal movement of the lever.

In the embodiment 10'' illustrated in FIGS. 7, 8, 9 and 10, the operating mechanism is essentially the same as illustrated in FIGS. 4–6 with the exception that the operating handle 26'' is separately formed from the body 12'' and is rotatable with respect thereto about the thrust bearing 93. The respective parts are designated with similar numerals. A length of tubing 95 is longitudinally positioned through the handle 26'' through the axial bone 91 and is of sufficient size to define a longitudinal conduit 97 within which the operating handle can longitudinally reciprocate. A set screw 97 is threadedly engaged through the body 12'' to secure the inner terminus of the tubing 95 in position. The outer end of the tube 95 terminates at the thrust bearing 93. Accordingly, the handle 26'' and the body 12'' are freely rotatable with with respect to each other. The axial bore 91 and the thrust bearing 93 cooperate to facilitate rotative movement of the handle 26'' relative to the body affixed tubing 95.

Figure 8:
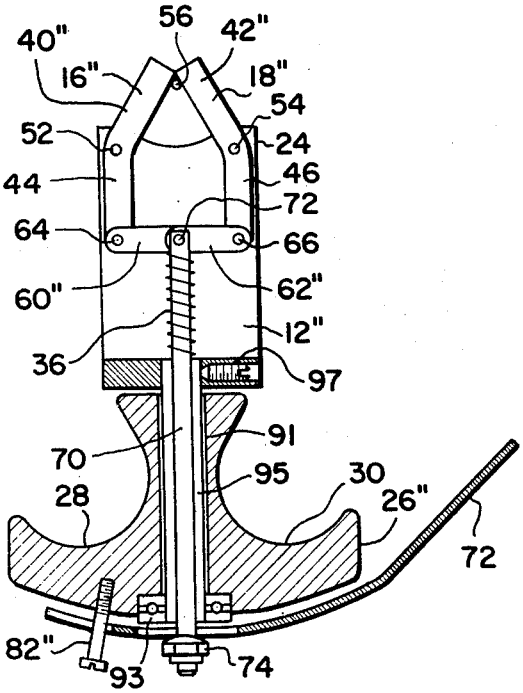
FIG. 8 is a cross sectional view taken along line 8—8 of FIG. 7, showing the jaws in the bow string drawing position.
Figure 9:
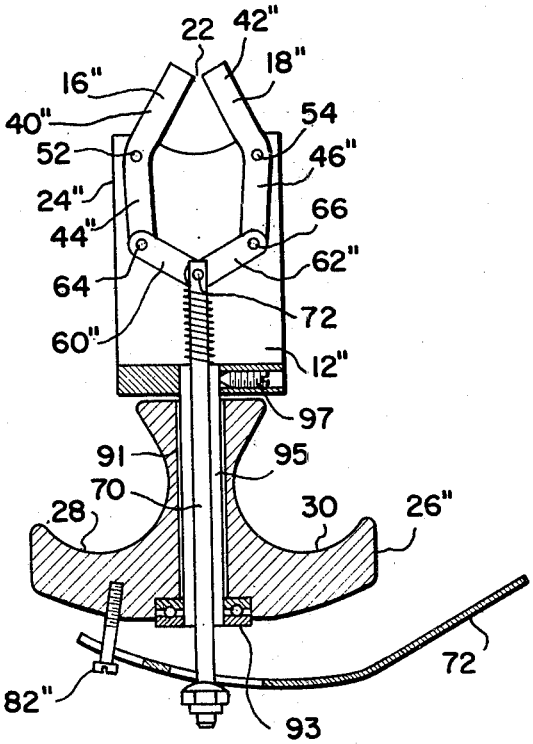
FIG. 9 is a cross sectional view similar to FIG. 8, showing the jaws in the bow string releasing position.

By employing the thrust bearing 93 and the separately constructed body 12'' and handle 26'', the handle can be rotated through three hundred and sixty degrees when the jaws 16'' and 18'' are engaged upon the bow string 56, as illustrated in FIG. 8. By employing this construction, the archer (not shown) can turn his hand to any angle that is comfortable to him when drawing the bow string 56 without applying any torque or twist whatsoever upon the bow string.

In the embodiment 10''' illustrated in FIGS. 11, 12 13 and 14, the operating mechanism is essentially the same as illustrated in FIGS. 4–6 except that an entirely different triggering mechanism is set forth. As illustrated, the jaws 16''', 18''' are bent intermediate their respective bow string engaging ends 40''', 42''' and their operating ends 44''', 46''' to define bent fulcrums. Respective pivot pins 52, 54 are positioned through the fulcrums to pivotally affix the jaws 16''', 18''' to the jaw holding portion 24''' of the body 12''' for pivotal operation relative to the body.

The bow string drawing means 14'''comprises the operating links 60''', 62''' which pivotally respectively connect to the operating ends 44''', 46''' of the jaws 16''', 18''' at the respective rear pivot pins 64, 66. In this embodiment, the links 60''', 62''' terminate inwardly in a longitudinally aligned pivotal connection 68, and pivotally interconnect with the forward end of the operating rod 70 at the interconnecting pivot pin 72. The spring 36 continuously biases the pivotal connection 68 forwardly to continuously urge the jaws to their bow string drawing position.

As illustrated in FIGS. 11–14, the embodiment 10''' comprises a pivot block 98 which is positioned immediately rearwardly of the housing 12''' and includes a longitudinal bore 99 through which the operating rod 70 is positioned. The bore 99 is fabricated of sufficient size to allow the pivot block 98 to be freely rotatable about operating rod 70. The pivot block may be fabricated of a tough, workable plastic such as Delran or nylon and is designed to rotate through 360 degrees relative to the rear shoulder 110 of the body 12'' to remove any torsional or twisting forces from acting upon the bow string 56 when the bow string is drawn rearwardly.

To enhance this rotational movement of the pivot block 98, a bearing 112 may be affixed to the operating rod 70 and the pivot block may be machined or otherwise formed to provide a recess of suitable size to receive the bearing 112. As illustrated, the bearing 112 is equipped with a projecting finger 114 for rotational limitation. In the embodiment illustrated, the pivot block recess is formed with rotatively spaced shoulders 116 which are positioned to be contacted by the finger 114 to thus limit the rotational movement of the pivot block 98 to ninety degrees. The finger 114 and the spaced shoulders 116 cooperate to provide limit means to limit the rotational movement of the handle grip portion.

The handle 26''' is positioned rearwardly of the pivot block 98 and is pivotally arranged relative to the pivot block terminus 109 for triggering purposes. As best seen in FIGS. 11 and 12, the handle bore 108 is V-shaped in cross section and terminates rearwardly in an elongated opening 113.

The shape of the bore 108 permits the handle 26''' to pivotally move relative to the operating rod 70 for triggering purposes. It will be noted that the rear nut 74 and the washer ride over the rear terminus 32 at the opening 113 during triggering. The handle 26''' is pivotally affixed to the pivot block 98 by a pair of straps 100, 102 which are respectively connected to the pivot block 98 and to the handle 26''' by upper and lower pivot pins 104, 106.

To use the device 10''', the bow string 56 is engaged in the usual manner and is pulled rearwardly by finger pressure at the surfaces 28, 30. Any twisting or torsional forces will be compensated automatically by rotation of the pivot block 98 and handle 26''' relative to the jaw body 12'''. In order to trigger the apparatus, the handle 26''' is angularly cocked relative to the pivot block 98 by pivoting about the straps 100, 102. See FIG. 13. This causes the nut 74 and washer or other abutment to ride over the curved rear handle surface 32 as the operating rod 70 moves within the V-shaped recess 108. The geometry of the system is such that the pivoting the handle 26'' pulls rearwardly on the opearing rod which in turn pulls the junction 68 rearwardly sufficiently to open the jaws to the position 22 for bow string release. (FIG. 13).

Referring now to FIG. 15, in the embodiment 10'''', the handle 26'''' is rotatable relative to the body 12'''' about the bearing 120. As illustrated, the jaws 16'''', 18'''' are pivotal about the pivot pins 52,54 in the manner hereinbefore described upon rearward movement of the operating rod 70. A U-shaped bracket 122 extends rearwardly from the body 12'''' and is rotatable about the operating rod through 360° relative to the body to isolate any twisting forces developed when drawing from the bow string. The spring 36 biases against the shoulder 34 in the manner hereinbefore described to normally urge the jaws 16'''', 18'''' to their closed, bow string drawing position.

Similar to the embodiment 10'''' illustrated in FIGS. 11–14, the handle 26'''' of the device illustrated in FIG. 15 comprises a V-shaped recess 108 which terminates rearwardly in an elongated opening 113. The rear nut 74 rides over the rear terminus 32 of the handle for triggering in the manner hereinbefore described. The handle 26'''' may be drilled or otherwise formed to provide a recess 128 which terminates outwardly in a shoulder 130. A spring 126 biases between the shoulder 130 and the operating rod 70 to normally urge the parts to their bow string engaging position as illustrated.

In order to use the embodiment of FIG. 15, the second finger 132 is placed in the finger grip area 140, the third finger 134 is placed in the finger grip area 142 and the fourth finger 136 is placed in the finger grip area 144. Then the bow string 56 can be evenly pulled back by a balanced pull utilizing the second finger 132 and the third finger 134. If desired, the handle 26'''' can be rotated relative to the body 12'''' by the operator simply turning his hand (not illustrated) to cause rotation about the bearing 120. When it is desired to trigger the device, more pressure can be applied by the third finger 134 and fourth finger 136 to cause the handle to pivot about the centrally positioned pivot pins 124. Movement of the operating rod 70 into the recess 108 upon pivoting will cause the jaws to open in the manner hereinbefore set forth. It will be appreciated that in this embodiment also, the fifth finger 138 could also be employed for manual triggering without pivoting the handle by directly pushing rearwardly upon the operating lever 76 to urge it rearwardly about the pin 82''''.

Although the present invention has been described with reference to the particular embodiments herein set forth, it is understood that the present disclosure has been made only by way of example and that numerous changes in the details of construction may be resorted to without departing from the spirit and scope of the invention. Thus, the scope of the invention should not be limited by the foregoing specification, but rather only by the scope of the claims appended hereto.

What is claimed is:

1. In a bow string drawing and releasing device, the combination of a body, said body comprising a forward, jaw holding portion and a rearward, handle grip portion;

bow string drawing means pivotally secured to the body, to draw a bow string, said bow string drawing means comprising a pair of openable jaws, said jaws being adapted to be pivoted within the body between a bow string drawing position wherein the jaws touch and a bow string releasing position wherein the jaws part to define a space therebetween;

closing means in contact with the bow string drawing means, said closing means being adapted to continuously tend to bias the jaws to the said bow string drawing position;

triggering means provided in the body to urge the bow string drawing means to the bow string releasing position by overcoming the bias of the said closing means, said triggering means comprising an operating rod extending longitudinally from the jaw holding portion entirely through the handle grip portion, the operating rod being adapted for reciprocal movement through the handle grip portion, the operating rod terminating rearwardly of the handle grip portion in an enlarged head; and an operating lever engaged with the enlarged head and pivotally connected to the handle grip portion, whereby the operating rod will be urged rearwardly when the operating lever is pivoted about the handle grip portion.

2. The device of claim 1 wherein the operating rod enlarged head is adapted to stop against the rear of the handle grip portion to limit the forward reciprocating movement of the operating rod relative to the handle grip portion.

3. In a bow string drawing and releasing device, the combination of a body, said body comprising a forward, jaw holding portion and a rearward, handle grip portion; rotative means to rotate the handle grip portion relative to the jaw holding portion;

bow string drawing means pivotally secured to the body, to draw a bow string, said bow string drawing means comprising a pair of openable jaws, said jaws being adapted to be pivoted within the body between a bow string drawing position wherein the jaws touch and a bow string releasing position wherein the jaws part to define a space therebetween;

closing means in contact with the bow string drawing means, said closing means being adapted to continuously tend to bias the jaws to the said bow string drawing position; and triggering means provided in the body to urge the bow string drawing means to the bow string releasing positon by overcoming the bias of the said closing means.

4. The device of claim 3 wherein the rotative means comprises a bearing.

5. The device of claim 4 wherein the rotative means comprises a hollow conduit extending between the jaw holding portion and the handle grip portion.

6. The device of claim 5 wherein part of the bow string drawing means is axially reciprocal through the conduit.

7. The device of claim 5 wherein the conduit is adapted to be secured to the jaw holding portion in a non-movable interconnection.

8. The device of claim 5 wherein the conduit terminates at one end in a non-movable connection to the jaw holding portion and at its other end at the said bearing.

9. In a bow string drawing and releasing device, the combination of a body, said body comprising a forward, jaw holding portion and a rearward, handle grip portion, bow string drawing means pivotally secured to the body, to draw a bow string, the said bow string drawing means comprising an operating rod, the operating rod being adapted to reciprocate through the handle grip portion, said bow string drawing means comprising a pair of openable jaws, said jaws being adapted to be pivoted within the body between a bow string drawing position wherein the jaws touch and a bow string releasing position wherein the jaws part to define a space therebetween;

closing means in contact with the bow string drawing means, said closing means being adapted to continuously tend to bias the jaws to the said bow string drawing position; and triggering means provided in the body to urge the bow string drawing means to the bow string releasing position by overcoming the bias of the said closing means, the triggering means comprising a pivotal connection between the handle grip portion and the jaw holding portion, whereby the operating rod can be pulled rearwardly relative to the bow string drawing means upon pivoting the handle grip portion about the pivotal connection and relative to the jaw holding portion.

10. The device of claim 9 wherein the handle grip portion is provided with a non-cylindrical bore and wherein the operating rod is reciprocal within the bore upon pivoting of the handle grip portion.

11. The device of claim 10 wherein the bore is generally triangular in configuration in longitudinal cross section.

12. The device of claim 9 wherein the operating rod terminates rearwardly in an abutment, the said abutment being adapted to slide over the rearward marginal edge of the handle grip portion when the handle grip portion is rotated to effect rearward movement of the operating rod relative to the jaw holding portion.

13. The device of claim 9 and a pivot block interposed between the handle grip portion and the jaw holding portion.

14. The device of claim 13 and rotative means to rotate the handle grip portion relative to the jaw holding portion.

15. The device of claim 14 wherein the rotative means comprises a bearing.

16. The device of claim 15 wherein the pivot block is formed to provide a recess and wherein the bearing is positioned within the recess.

17. The device of claim 9 and a U-shaped bracket interposed between the handle grip portion and the jaw holding portion.

18. The device of claim 17 wherein the U-shaped bracket is adapted to rotate through 360° relative to the jaw holding portion.

19. The device of claim 18 and a bearing associated with the U-shaped bracket to facilitate rotation of the handle grip portion relative to the jaw holding portion.

20. The device of claim 17 wherein the handle grip portion connects to the U-shaped bracket.

21. The device of claim 20 wherein the connection between the handle grip portion and the bracket is pivotal.

22. The device of claim 21 wherein the U-shaped bracket is adapted to rotate through 360° relative to the jaw holding portion.

23. The device of claim 21 wherein the said pivotal connection is centrally positioned.

24. The device of claim 21 wherein the said pivotal connection is aligned with the operating rod whereby the handle grip portion may be pulled rearwardly with a balanced pull.

* * * * *